US005339569A

United States Patent [19]

Piggen

[11] Patent Number: 5,339,569

[45] Date of Patent: Aug. 23, 1994

[54] SURFACE PROCESSING DEVICE

[75] Inventor: Wilhelmus A. J. Piggen, Oud-Gastel, Netherlands

[73] Assignee: Linden Machines B.V., Goes, Netherlands

[21] Appl. No.: 135,316

[22] Filed: Oct. 12, 1993

Related U.S. Application Data

[63] Continuation of Ser. No. 835,697, Feb. 12, 1992, abandoned.

[30] Foreign Application Priority Data

Feb. 14, 1991 [NL] Netherlands ..... 9100264

[51] Int. Cl.[5] ..... B24B 7/00

[52] U.S. Cl. ..... 51/109 R; 51/119; 51/122

[58] Field of Search ..... 51/54, 55, 56 R, 109 R, 51/110, 119, 120, 121, 122, 134.5 R, 134.5 F, 406, 266, 267, 270, 273

[56] References Cited

U.S. PATENT DOCUMENTS

| | | | |
|---|---|---|---|
| 2,771,718 | 11/1956 | Gustafson et al. | 51/55 |
| 2,865,142 | 12/1958 | Dunipace et al. | 51/120 |
| 2,948,087 | 8/1960 | Caton | 51/120 |
| 3,107,457 | 10/1963 | Walters et al. | 51/119 |
| 3,233,369 | 2/1966 | Highberg | 51/110 |
| 4,053,288 | 10/1977 | Baron, Sr. | 51/109 R |
| 4,112,534 | 9/1978 | Hovengen | 51/120 X |
| 4,263,755 | 4/1981 | Globus . | |
| 4,380,092 | 4/1983 | Brothers . | |
| 4,437,269 | 3/1984 | Shaw | 51/406 X |
| 4,617,767 | 10/1986 | Ali | 51/406 X |
| 5,016,399 | 5/1991 | Vinson | 51/119 X |

FOREIGN PATENT DOCUMENTS

| | | | |
|---|---|---|---|
| 376392 | of 1984 | Austria | B27H 1/00 |
| 3803857 | of 1988 | Fed. Rep. of Germany | B24B 9/04 |
| 9011134 | of 1991 | Fed. Rep. of Germany | B24B 7/00 |
| 8802627 | of 1988 | Netherlands | B24B 7/02 |

*Primary Examiner*—M. Rachuba
*Attorney, Agent, or Firm*—Webb Ziesenheim Bruening Logsdon Orkin & Hanson

[57] ABSTRACT

A device for processing the surface of objects (V) such as grinding, polishing and deburring for instance punched workpieces, which device comprises: a transporting surface (2) for receiving the objects for processing, a grinding unit (4) arranged thereabove consisting inter alia of a grinding body (36) extending parallel to the transporting surface, a carrier (5) which supports the grinding body and which is driven rotatably by a motor (21) about at least two standing crank shafts (6) in a plane parallel to the transporting surface, wherein the carrier with the driving is contained in a holder (9) which is upwardly tiltable about a lying shaft (26) so that the grinding body (36) can be easily replaced with a new grinding body and wherein an improved cooling liquid circulation (43, 50, 51) is arranged, whereby the standstill period of the machine is considerably shortened and the grinding or polishing action is improved.

27 Claims, 4 Drawing Sheets

SURFACE PROCESSING DEVICE

This is a continuation of copending application Ser. No. 07/835,697 filed on Feb. 12, 1992 now abandoned.

The invention relates to a device for processing the surface of objects such as grinding, polishing and deburring for instance punched workpieces, which device comprises:

a transporting surface for receiving the objects for processing, a grinding unit arranged thereabove consisting inter alia of a grinding body extending parallel to the transporting surface, a carrier which supports the grinding body and which is driven rotatably by a motor around at least two standing crank shafts in a plane parallel to the transporting surface.

As a result of the crank shaft mounting of the carrier the grinding body will undergo an oscillating movement relative to the transporting movement of the objects for processing. This provides a large degree of accuracy on the surface of the object for grinding in respect of planeness and an effective deburring of the edges along the periphery and along punched holes in the object.

Such a device is known from the Netherlands patent application 88.02627.

The present invention has for its object to improve the above mentioned device and provides to this end a device distinguished in that the carrier with the driving is contained in a holder which is upwardly tiltable about a lying shaft.

Due to this construction it is possible to replace the grinding surface of the grinding body with a new grinding surface, whereby the standstill period of the machine is considerably shortened. This moreover improves the effective processing of the surfaces.

According to a further development of the invention wherein the device can be provided with a circular carrier, the drive motor is coupled via a centrally located intermediate shaft to the crank shafts for driving by means of an appropriate transmission, for instance tooth belts, tooth wheels etc.

In this latter embodiment it is recommended to mount and drive the carrier itself rotatably in the holder round the central shaft. Obtained herewith is an optimum polishing process, since the workpiece surface is not only polished by the oscillating movement of the grinding body but also by the rotating movement thereof, which composite movement gives a continually changing grinding pattern. Furthermore, the abrasive surface of the grinding body is used optimally, which reduces and equalizes wear thereof over the entire surface.

For easy removal of the abrasive layer it is recommended to provide the grinding body with a velcro mat coacting with an adhesion layer arranged on the abrasive layer.

The polishing action is furthered according to the invention by applying a liquid which respectively carries away the grinding or polishing debris and cools the objects, for which purpose the holder is provided according to the invention with a liquid feed conduit arranged in the central intermediate shaft and debouching on the top side of the carrier. This provides a uniform distribution of the liquid over the objects.

The liquid is preferably collected in a reservoir arranged beneath the transporting surface.

If the transporting surface has a perforated form and is provided with a vacuum conduit debouching under the mat for the purpose of holding the objects fixedly on the transporting surface during the grinding and polishing operation, the invention then further proposes arrangement of a separating tank at a higher level than the liquid reservoir, wherein the vacuum conduit connects onto the separating tank connected to a vacuum source, wherein an overflow conduit of the tank leads to the liquid reservoir. Thus realized is a cycle of the processing liquid, wherein the consumption is limited. The separating tank provides a dry discharge of the vacuum air required for adhesion of the objects.

Finally, the invention proposes to arrange a drying device behind the transporting surface which preferably consists of one or more roller pairs in addition to a compressed air chamber with elongate outflow opening extending over the full width of the transporting surface.

The pressure flow direction of the elongate outflow opening is preferably oriented at a forward inclination relative to the transporting direction.

The invention is further elucidated in the figure description hereinbelow of a number of embodiments. In the drawing.

Figure 1:
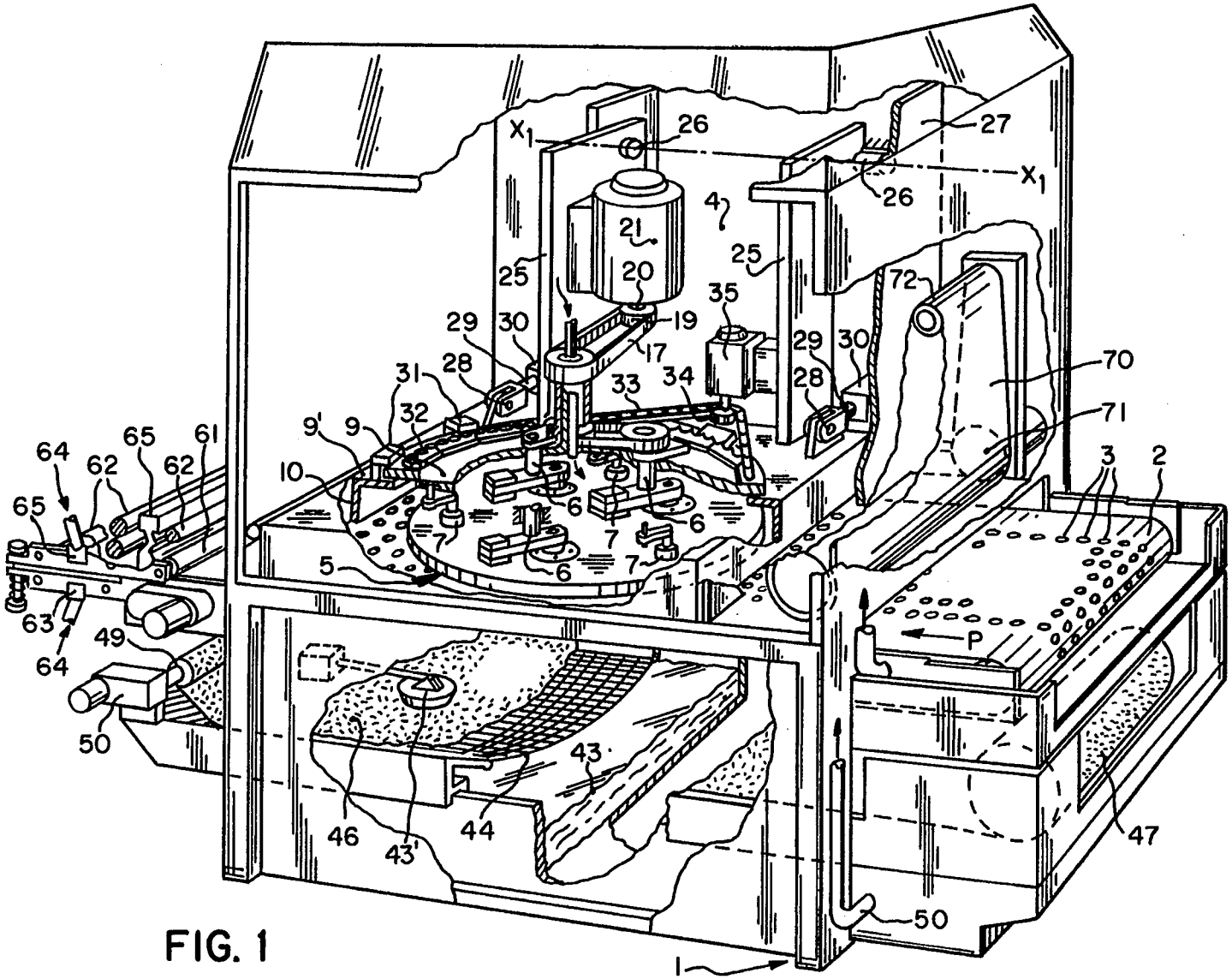
FIG. 1 shows a perspective view of a device according to the invention wherein the outer plating is partially broken away for elucidation of the active parts thereof.

Designated in the figures with the numeral 1 is the frame of the device which can consist of any suitable construction material, for instance profiles and plates. Arranged in the frame 1 is a conveyor belt 2, the top surface of which forms the transporting surface for the objects for processing. The conveyor belt is embodied here as an endless belt and is trained round reversing rollers at either end of frame 1. Further arranged is a vacuum chamber, which is further elucidated hereinbelow, the upper wall of which and the conveyor belt 2 itself take a porous form, that is, are provided with perforations 3.

Arranged above the transporting surface of the conveyor belt 2 is a processing unit for respectively grinding and polishing the objects, which processing unit is designated as a whole with 4. The unit consists of a carrier 5 which is circular in the embodiment according to FIG. 1. The carrier 5 is suspended on six crank shafts whereof three 6 are driven and three 7 are free-turning. The three driven crank shafts 6 are mounted in a holder 9 consisting of a flat plate, the outer periphery of which has a downward oriented edge strip 10 whereof the bottom ends at a distance above the transporting surface 2.

Figure 2:
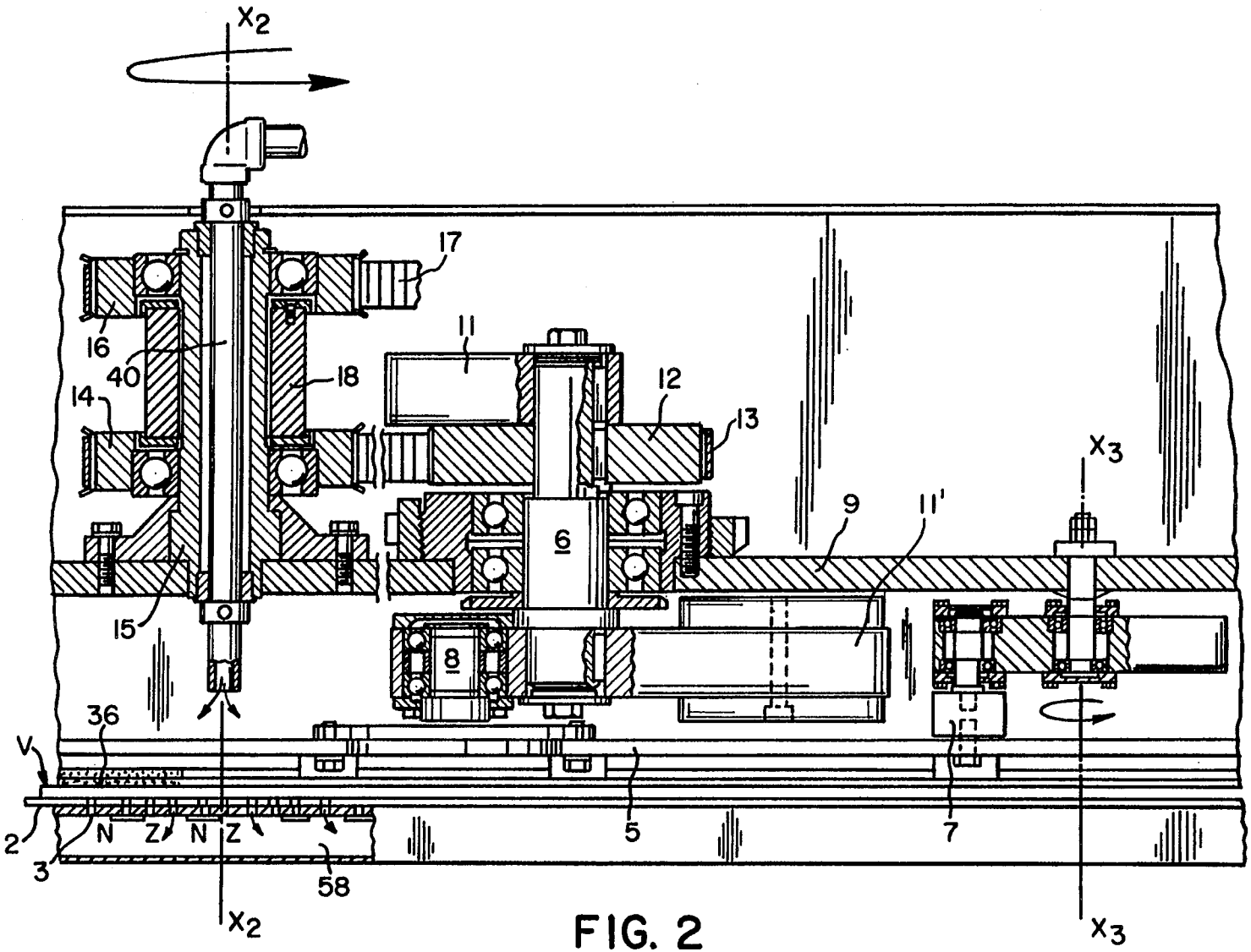
FIG. 2 shows a standing section of a portion of the holder with carrier and grinding body of the device of FIG. 1.

The crank webs of the crank shafts 6, 7 thus lie respectively on the underside of holder 9 and the top side of carrier 5 (see also FIG. 2). The crank webs of the crank shafts 6 are coupled to the carrier 5 via a journal 8 which is fixedly bolted on the top side of carrier 5.

Counterweights 11 are arranged opposite the crank web of the crank shaft 6 in order to compensate the eccentricity of the driving. The crank shaft 6 is moreover located on the side above holder 9 and likewise provided with a counterweight 11.

Fixed non-rotatably under the counterweight 11 is a tooth wheel 12 around which is trained a tooth belt 13 which leads to a tooth wheel 14 that is rotatably mounted about a central sleeve 15 which is fixed on top of the holder 9. The bearing sleeves 15 also serve as support for rotatable mounting of a second tooth wheel 16 around which is trained a tooth belt 17. The tooth wheel 16 is connected to tooth wheel 14 via an intermediate sleeve 18. The tooth belt 17 leads to a pinion 19 on the underside of the output shaft 20 of a drive motor 21.

The holder 9 is provided at the rear in FIG. 1 with two standing plates 25 which are fixedly attached thereto. The motor 21 is fixed to the inside of the left-hand plate 25.

The plates 25 have pivot pins 26 which are themselves mounted in a plate 27 of frame 1. A first axis $X_1$ passes through pins 26. The holder 9 is provided at the rear with an ear 28 onto which the cylinder rod 29 of a pressure cylinder 30 engages pivotally. The pressure cylinder 30 supports against a component (not further shown) of the frame 1.

It is noted that the carrier 5 shown in FIG. 1 is circular and that a central part of the holder 9 is likewise given a circular form and is rotatably mounted in the outer portion 9' of the carrier fixed to the support plates 25. The central part 9 is held inside guidings 31, this such that the central part 9 of the holder can be provided on the top side with tooth segment-like parts 32 which form a closed circle on the central part 9. Trained around these tooth segment parts 32 is an endless chain 33 which is driven by a pinion 34 of a second motor 35 which is mounted on the inside of the right-hand plate 25.

It is noted herein that the central bearing sleeve 15 is in the middle of the central part 9 of the holder and of the carrier 5 respectively.

The device described up to this point operates as follows.

By causing the tooth wheels 16 and 14 to rotate on the central shaft by means of the drive system from the motor 21 via tooth belt 17, the tooth belt 13 will be set into rotation and thus the tooth wheel 12 on the right-hand crank shaft 7 in FIG. 1 and FIG. 2. The journal 8 on the plate carrier 5 will thereby begin to describe a circular path around the crank shaft 7 around a third axis $X_3$, which passes through crank shaft 7 and the grinding body, carrying the plate 5 with it in an oscillating movement. The two other non-driven but balanced crank mechanisms 6 will move synchronously therewith and provide an accurate planar guiding of the carrier 5 relative to the transporting surface on the conveyor belt 2. The auxiliary crank shafts 7 further the planar position of the carrier 5.

The central part 9 of the holder 9' is herein set into rotation through energizing of the motor 35 which sets the pinion 34 into rotation and thereby drives the chain 33. The central part will begin to rotate around a second central axis $X_2$, which passes through the grinding body and carrier 5 of the central bearing sleeve 15. It will be apparent that the abrasive surface arranged on the underside of the carrier 5 undergoes a composite movement, that is, a rotating and oscillating movement. This movement extends over the full width of the conveyor belt 2 and thereby furthers optimal processing of the surface of the objects located on conveyor belt 2. The objects are moreover carried through under the carrier 5 in the direction of the arrow P1.

In order to exchange the abrasive surface on the underside of carrier 5 the cylinders 30 can be actuated, whereby the plates 25 are tilted upward with the holder 9 and carrier 5 about the axis defined by the journals 26. The underside then becomes visible and accessible to the operative who is positioned to the front of the device in FIG. 1 so that he can easily remove the abrasive surface.

Figure 5:
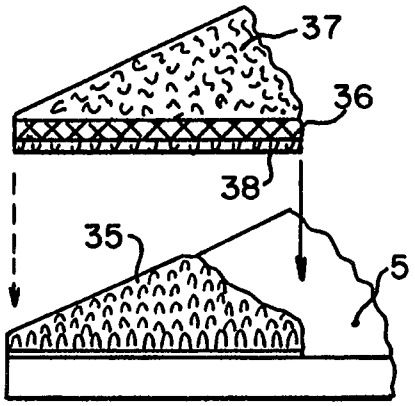
FIG. 5 is a detail of the grinding body with velcro mat and abrasive layer for arranging thereon, as seen from the underside thereof.

Reference is made in this respect to the construction according to FIG. 5 wherein the carrier plate 5 is provided with a velcro mat 35 onto which is adhered a layer of abrasive material 36 which is provided on the side remote from the abrasive side 37 with a layer 38 co-acting with the velcro mat. Due to this adhesion it is sufficient to fix the grinding material 36, for example non-woven, web-like grinding material, to the underside of carrier 5 by pressing-on.

There now follows with reference to FIGS. 1 and 2 a description of the circulation through the machine of the air required for adhering the objects on the conveyor belt 2 and the liquid, for example water or the like, required for the surface processing.

Received into the central bearing sleeve 15 is a tube conduit 40 which connects onto a pressure conduit 41 which leads to the output of a liquid pump 42. Placed on the underside of the conveyor belt 2 is a liquid reservoir 43 which is covered on the top by a filter mat 44. This filter mat allows passage of liquid but obstructs passage of the grinding debris, which can be collected on the mat and carried away by any suitable system, for instance a removable paper layer arranged on the mat 44. This paper layer 46 can be taken off a supply roll 47 and wound up on a reel shaft 49. Shaft 49 can be driven by a motor transmission system 49'.

The liquid reservoir 43 is connected to a discharge conduit 50 which leads to a separating tank 51 arranged in the upper part of the frame 1. The separating tank 51 is a closed chamber provided with partitions 52 on the right-hand side of which is arranged an outlet 53 which leads to a vacuum source, for instance a fan motor 54. Arranged on the opposite side of the partition 52 is the intake opening 55 onto which is connected an air conduit 56 which branches off into branch conduits 57 debouching in the vacuum chamber 58 on the underside of the perforated belt 2 of the conveyor.

The circulation of the air and liquid respectively is as follows.

By actuating the fans 54 and the pump 42 a vacuum is realized in the separating tank 51 by the fan, which vacuum is likewise applied in the vacuum chamber 58 under the conveyor belt 2 via the conduits 56, 57. The liquid from the liquid reservoir 43 is pumped by the pump 42 via conduit 41 into the middle of the carrier 5 where it spreads over carrier 5 and over the belt 2. The excess water is herein collected partly in the air chamber 58 and partly in the liquid reservoir 43. The mixture of liquid and air present in the air chamber is carried away via the conduits 57 and 56 to the separating tank 51, wherein the air is discharged via the fan 54 and the water returns via the fall pipe 50 to the liquid reservoir 43 filled to above the outlet opening thereof. The level in the liquid reservoir is controlled for this purpose by a float 43'.

The upper surface of the vacuum chamber 58 can be provided in addition to the perforations therein with magnet strips to fixedly hold objects of magnetizable material on the conveyor belt 2. It is noted that the objects are preferably set down in the middle of the conveyor belt 2 so that in the case of a circular carrier the longest polishing path is followed equivalent to the outer diameter of the carrier.

There now follows a description of the drying device on the rear part or spaced downstream of the conveyor belt 2, that is, the lefthand side in FIG. 1 and FIG. 2.

Figure 3:
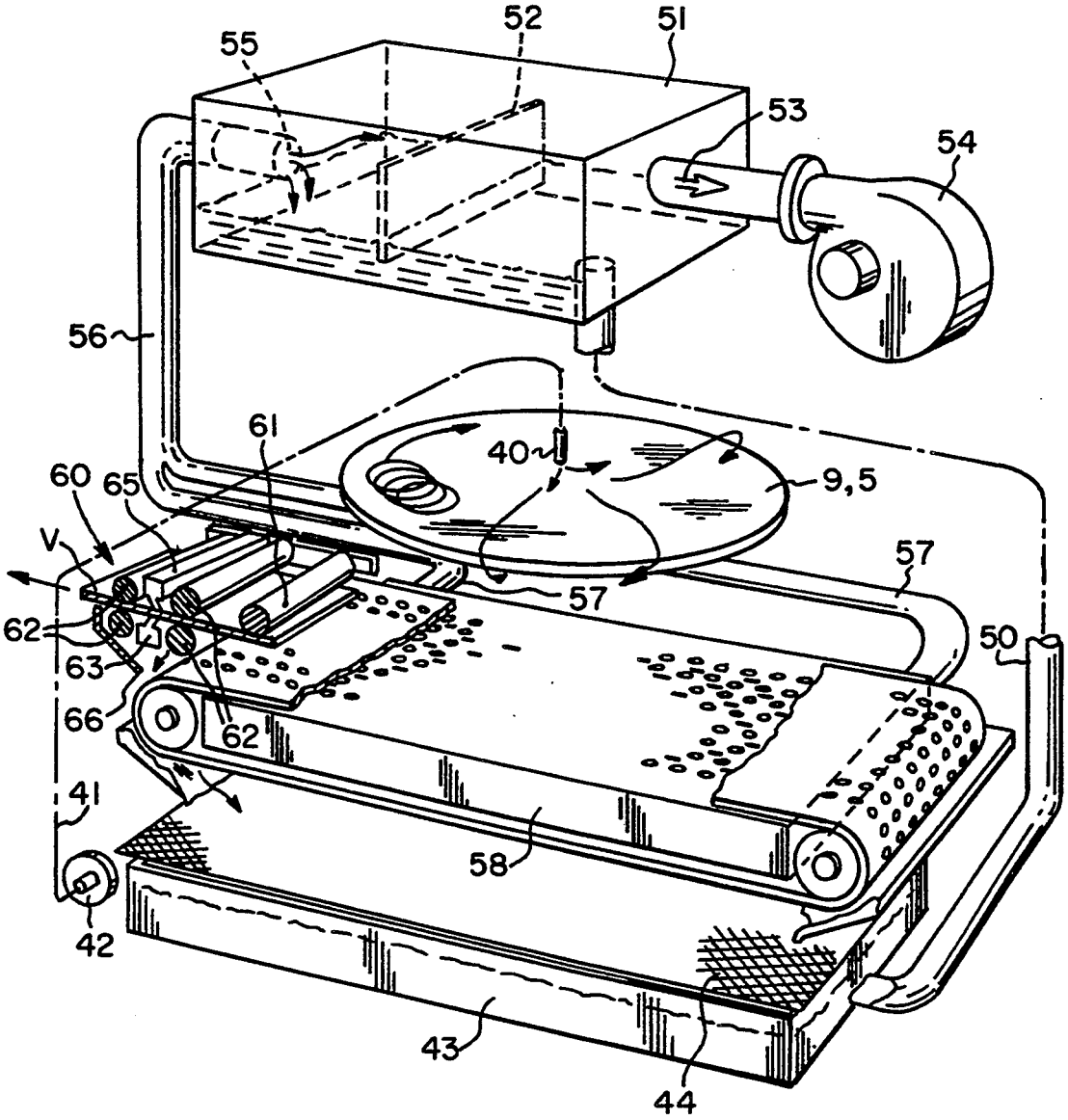
FIG. 3 is a perspective view corresponding with FIG. 1 in which the liquid cycle is shown schematically.

In the embodiment shown the drying device consists of three pairs of rollers 60, whereof the first pair, that is, the right-hand pair in FIGS. 1 and 3, is formed by a pressure roller 61 arranged above the reversing roller of conveyor 2. There are two subsequent pairs of pressure rollers 62 connected one behind the other, between which an air chamber is arranged above and below the passage opening between the rollers. This air chamber 63 is supplied by a pressure source 64 which is not further shown.

The air chambers 63 have an elongate outflow opening 65 which extends over the full width of the belt and which causes an air flow directed against or opposite to the transporting direction P1.

When objects V pass through between the roller pairs 61, 62 the top and bottom surfaces of the object V are blown dry by a powerful air flow flowing from the air chamber 63. Any liquid that may drop down is carried away via a baffle 66 to the liquid reservoir 43.

Finally, it is also mentioned that on the front side of the processing unit 4 in relation to the transporting direction P1 an abrading unit 70 can be arranged which may consist of a vertically placed abrasive belt 71 which is trained round an upper reversing roller 72 and a driven lower reversing roller 73. The lower reversing roller 73 is placed such that the abrading surface of the belt 70 can grind the top surface of the objects V situated on the conveyor belt 2.

Figure 4:
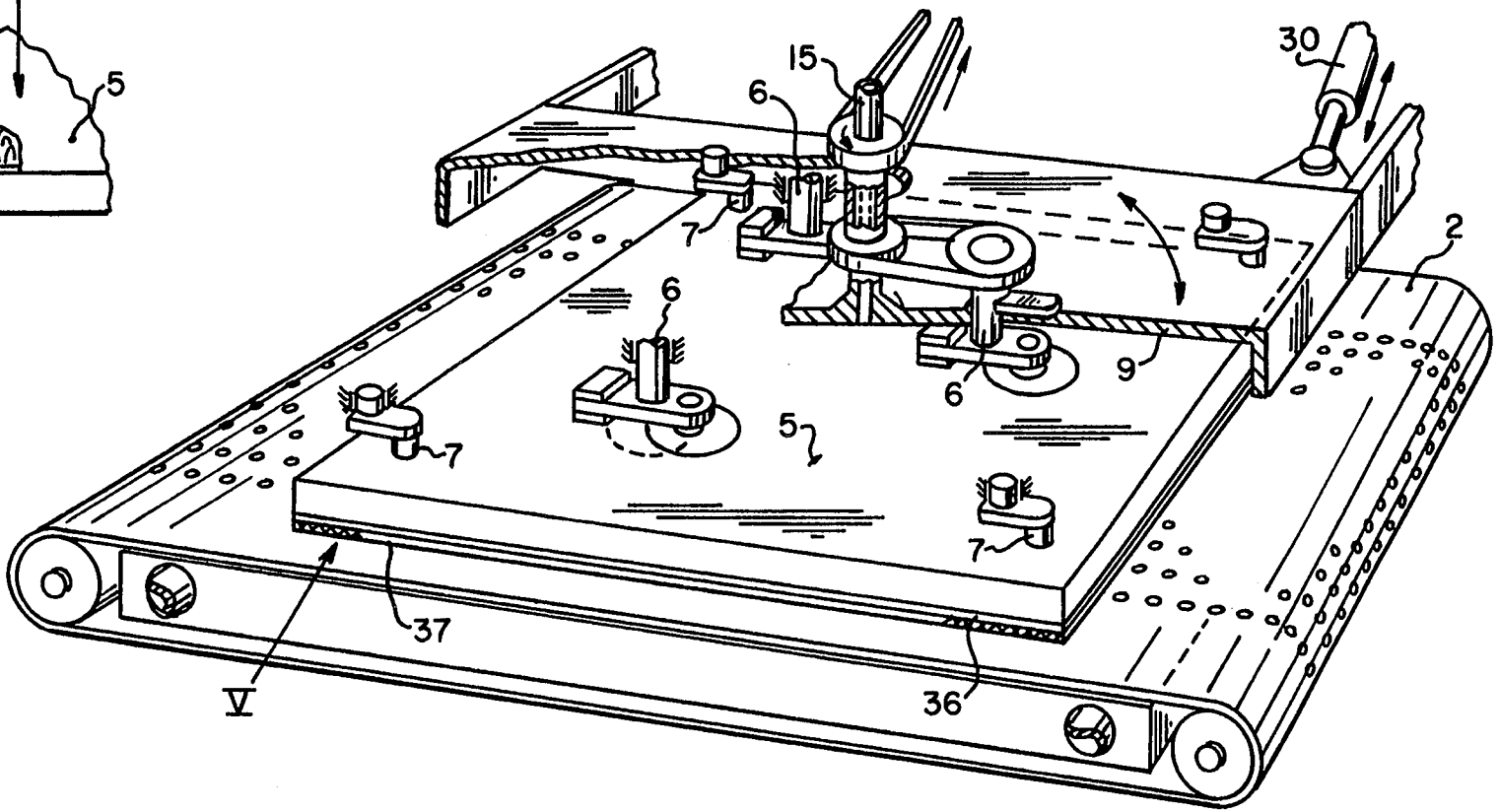
FIG. 4 is a perspective top view of a second embodiment of the device according to the invention.

An alternative embodiment of the carrier 5 is shown in FIG. 4. Here the carrier 5 is not circular but rectangular or square, wherein the width corresponds virtually with that of the conveyor 2. The rectangular plate is here also suspended on three crank shafts 6 which are balanced and three auxiliary crank shafts 7 in the corners of the plate. The driving of one of the crank shafts 6 takes place in the manner described above with reference to FIG. 1. The crank shafts 6 are mounted in a carrier 9 which is likewise tiltable upward about an axis by means of a cylinder 30 such that the underside of carrier 5 is released from the conveyor belt 2 and becomes accessible to the operative for removal and replacement of the grinding material 36.

It is noted that the bearing sleeve 15 on carrier 9 does not have to have a central position but can have any random suitable position relative to the plate 5. It is further noted that the grinding material 36 undergoes only an oscillating movement relative to the conveyor belt 2 and not a rotating movement.

The invention is not limited to the above described embodiments wherein the devices described can moreover be provided with auxiliary units other than shown.

I claim:

1. A device for processing the surface of objects comprising:

a frame; a transporting surface for receiving the objects for processing attached to the frame; and a grinding unit attached to the frame and arranged above the transporting surface, said grinding unit including a grinding body extending parallel to the transporting surface, a carrier which supports the grinding body and which is driven rotatably by a motor about at least two standing crank shafts in a plane parallel to the transporting surface, a holder and a journal attached to the frame wherein the carrier attaches to the holder by the crank shafts, and the holder attaches to the journal so that the carrier is tiltable about a first axis ($X_1$) defined by the journal, wherein the carrier takes a circular form and the motor drives at least one of the crank shafts via a centrally located intermediate shaft, which rotatably drives the carrier in the holder about a central intermediate shaft, resulting in a rotating movement about a second central axis $X_2$ passing through the grinding body and said carrier and an oscillating movement about a third axis $X_3$ passing through the grinding body and one of said crank shafts.

2. A device as claimed in claim 1, wherein the grinding body includes a velcro mat for adhering an abrasive layer which co-acts with the velcro mat.

3. A device as claimed in claim 1, wherein the holder is provided with a liquid feed conduit arranged in a central intermediate shaft and debouching on a top side of the carrier.

4. A device as claimed in claim 3, further comprising a liquid reservoir arranged beneath the transporting surface.

5. A device as claimed in claim 1, further comprising a vacuum conduit wherein the transporting surface is perforated and is connected to the vacuum conduit, an air-liquid separating tank having an overflow conduit arranged at a higher level than a liquid reservoir, wherein the vacuum conduit connects onto the air-liquid separating tank, a vacuum source connected to the air-liquid separating tank, and an overflow conduit of the tank leading to the liquid reservoir wherein the overflow conduit debouches below the liquid level therein.

6. A device as claimed in claim 1, further comprising a drying device arranged downstream of the transporting surface.

7. A device as claimed in claim 6, wherein the drying device includes one or more roller pairs and at least one compressed air chamber is arranged with an elongate outflow opening extending over the full width of the transporting surface.

8. A device as claimed in claim 7, wherein the elongate outflow opening is formed so that air flow exiting from the elongate outflow opening is in a direction that is opposite to a transporting direction of the transporting surface.

9. A device as claimed in claim 1, further comprising a vacuum chamber arranged beneath the transporting surface, the vacuum chamber having an upper surface with perforations and one or more magnet strips.

10. A device as claimed in claim 1, wherein the grinding body is circular shaped.

11. A device as claimed in claim 1, wherein the grinding body is rectangular shaped.

12. A device as claimed in claim 1, wherein the grinding body includes a velcro mat for adhering an abrasive layer which co-acts with the velcro mat.

13. A device as claim in claim 1, wherein the grinding body includes a velcro mat for adhering an abrasive layer which co-acts with the velcro mat.

14. A device as claimed in claim 2, wherein the holder is provided with a liquid feed conduit arranged in a central intermediate shaft and debouching on a top side of the carrier.

15. A device as claimed in claim 5, further comprising a drying device arranged downstream of the transporting surface.

16. A device as claimed in claim 8, further comprising a vacuum chamber arranged beneath the transporting surface, the vacuum chamber having an upper surface with perforations and one or more magnet strips.

17. A device as claimed in claim 9, wherein the grinding body is circular shaped.

18. A device as claimed in claim 4, further comprising a vacuum conduit wherein the transporting surface is perforated and is connected to a vacuum conduit, an air-liquid separating tank having an overflow conduit arranged at a higher level than a liquid reservoir, wherein the vacuum conduit connects onto the air-liquid separating tank, a vacuum source connected to the air-liquid separating tank, and an overflow conduit of the tank leading to the liquid reservoir wherein the overflow conduit debouches below the liquid level therein.

19. A device for processing the surface of objects comprising:

a frame; a transporting surface for receiving the objects for processing attached to the frame; a grinding unit attached to the frame and arranged above the transporting surface, said grinding unit including a grinding body extending parallel to the transporting surface, a carrier which supports the grinding body and which is driven rotatably by a motor about at least two standing crank shafts in a plane parallel to the transporting surface, a holder and a journal attached to the frame wherein the carrier attaches to the holder by the crank shafts, and the holder attaches to the journal so that the carrier is tiltable about an axis defined by the journal; and a vacuum chamber arranged beneath the transporting surface, the vacuum chamber having an upper surface with perforations and one or more magnet strips.

20. A device as claimed in claim 19, wherein the grinding body is circular shaped.

21. A device for processing the surface of objects comprising:

a frame; a perforated transporting surface for receiving the objects for processing attached to the frame; a grinding unit attached to the frame and arranged above the transporting surface, said grinding unit including a grinding body extending parallel to the transporting surface, a carrier which supports the grinding body and which is driven rotatably by a motor about at least two standing crank shafts in a plane parallel to the transporting surface, a holder and a journal attached to the frame wherein the carrier attaches to the holder by the crank shafts, and the holder attaches to the journal so that the carrier is tiltable about an axis defined by the journal; a vacuum conduit connected to the transporting surface; an air-liquid separating tank having an overflow conduit arranged at a higher level than a liquid reservoir, wherein the vacuum conduit connects onto the air-liquid separating tank; a vacuum source connected to the separating tank; and an overflow conduit attached to the tank leading to the liquid reservoir wherein the overflow conduit debouches below the liquid level therein.

22. A device for processing the surface of objects comprising:

a frame; a transporting surface for receiving the objects for processing attached to the frame; a grinding unit attached to the frame and arranged above the transporting surface, said grinding unit including a grinding body extending parallel to the transporting surface, a carrier which supports the grinding body and which is driven rotatably by a motor about at least two standing crank shafts in a plane parallel to the transporting surface, a holder and a journal attached to the frame wherein the carrier attaches to the holder by the crank shafts, and the holder attaches to the journal so that the carrier is tiltable about an axis defined by the journal; and a drying device arranged downstream of the transporting surface.

23. A device as claimed in claim 22, wherein the drying device includes one or more roller pairs and at least one compressed air chamber is arranged with an elongate outflow opening extending over the full width of the transporting surface.

24. A device as claimed in claim 23, wherein the elongate outflow opening is formed so that air flow exiting from the elongate outflow opening is in a direction that is opposite to a transporting direction of the transporting surface.

25. A device as claimed in claim 21, further comprising a drying device arranged on a rearward part of the transporting surface.

26. A device as claimed in claim 24, further comprising a vacuum chamber arranged beneath the transporting surface, the vacuum chamber having an upper surface with perforations and one or more magnet strips.

27. A device for processing the surface of objects comprising:

a frame; a perforated transporting surface for receiving the objects for processing attached to the frame; a grinding unit attached to the frame and arranged above the transporting surface, said grinding unit including a grinding body extending parallel to the transporting surface, a carrier which supports the grinding body and which is driven rotatably by a motor about at least two standing crank shafts in a plane parallel to the transporting surface, a holder, wherein the holder is provided with a liquid feed conduit arranged in a central intermediate shaft and debouching on a top side of the carrier, and a journal attached to the frame wherein the carrier attaches to the holder by the crank shafts, and the holder attaches to the journal so that the carrier is tiltable about an axis defined by the journal; a liquid reservoir arranged beneath the transporting surface; a vacuum conduit connected to the transporting surface; an air-liquid separating tank arranged at a higher level than a liquid reservoir, wherein the vacuum conduit connects onto the air-liquid separating tank; a vacuum source connected to the air-liquid separating tank; and an overflow conduit attached to the tank, the overflow conduit leading to the liquid reservoir wherein the overflow conduit debouches below the liquid level therein.

* * * * *

UNITED STATES PATENT AND TRADEMARK OFFICE

CERTIFICATE OF CORRECTION

PATENT NO. : 5,339,569

DATED : August 23, 1994

INVENTOR : Wilhelmus A. J. Piggen

It is certified that error appears in the above-indentified patent and that said Letters Patent is hereby corrected as shown below:

Delete Claims 12-13, Lines 61-66, Column 6.

Signed and Sealed this

Twenty-eight Day of February, 1995

*Attest:*

Bruce Lehman

BRUCE LEHMAN

*Attesting Officer*

*Commissioner of Patents and Trademarks*